US008721115B2

(12) United States Patent
Ing et al.

(10) Patent No.: US 8,721,115 B2
(45) Date of Patent: May 13, 2014

(54) LIGHT REFLECTIVE STRUCTURE AND LIGHT PANEL

(75) Inventors: Wen-Chiun Ing, Xindian (TW); Wei-Hsin Hou, Taipei (TW); Zhi-Wei Koh, Zhubei (TW); Chi-Jen Kao, Taipei (TW)

(73) Assignee: Luxingtek, Ltd., Zhubei (TW)

( * ) Notice: Subject to any disclaimer, the term of this patent is extended or adjusted under 35 U.S.C. 154(b) by 232 days.

(21) Appl. No.: 13/104,736

(22) Filed: May 10, 2011

(65) Prior Publication Data

US 2011/0292655 A1 Dec. 1, 2011

Related U.S. Application Data

(60) Provisional application No. 61/349,522, filed on May 28, 2010.

(51) Int. Cl.
*F21V 13/04* (2006.01)
*F21V 17/06* (2006.01)

(52) U.S. Cl.
USPC ..... 362/245; 362/241; 362/246; 362/247; 362/309; 362/328; 362/331; 362/350; 362/433

(58) Field of Classification Search
USPC ..... 362/241, 245, 246, 247, 331, 332, 97.3, 362/327, 328, 330, 347, 350, 309, 433, 455
See application file for complete search history.

(56) References Cited

U.S. PATENT DOCUMENTS

| | | | | |
|---|---|---|---|---|
| 4,345,308 | A * | 8/1982 | Mouyard et al. | 362/332 |
| 5,490,049 | A * | 2/1996 | Montalan et al. | 362/240 |
| 5,580,156 | A * | 12/1996 | Suzuki et al. | 362/184 |
| 5,779,351 | A * | 7/1998 | Erickson et al. | 362/241 |
| 6,367,950 | B1 * | 4/2002 | Yamada et al. | 362/245 |
| 6,825,420 | B2 * | 11/2004 | Schreck et al. | 174/117 F |
| 6,871,982 | B2 * | 3/2005 | Holman et al. | 362/331 |
| 6,964,489 | B2 * | 11/2005 | Blume et al. | 362/27 |
| 7,581,850 | B2 * | 9/2009 | Liao | 362/245 |
| 7,611,262 | B2 * | 11/2009 | Chang | 362/246 |
| 7,726,828 | B2 * | 6/2010 | Sato | 362/97.3 |
| 7,938,559 | B2 * | 5/2011 | Angelini et al. | 362/241 |
| 8,079,730 | B2 * | 12/2011 | Wilm | 362/240 |
| 8,157,414 | B2 * | 4/2012 | Schaefer et al. | 362/245 |
| 8,251,546 | B2 * | 8/2012 | Chen et al. | 362/297 |
| 8,267,543 | B2 * | 9/2012 | Park | 362/241 |
| 2006/0268548 | A1 * | 11/2006 | Chang | 362/245 |
| 2007/0165403 | A1 | 7/2007 | Park | |

* cited by examiner

*Primary Examiner* — Alan Cariaso
(74) *Attorney, Agent, or Firm* — Ditthavong Mori & Steiner, P.C.

(57) ABSTRACT

A light panel is disclosed. The light panel comprises a circuit assembly, a plurality of light sources, a light reflective structure, and a diffuser layer. The light reflective structure has a plurality of concaves, which are continuously connected to form a plurality of ridges. Each of the concaves has an opening formed on the bottom surface thereof, and each of the light sources is disposed corresponding to each of the openings of the concaves. The diffuser layer is supported by the ridges of the light reflective structure. In some aspects of the present invention, the diffuser layer may have a sloping inner surface or is coated with patterned diffuser coatings on the top surface. Each light source can be added with a lens.

18 Claims, 15 Drawing Sheets

LIGHT REFLECTIVE STRUCTURE AND LIGHT PANEL

This application claims priority to U.S. Provisional Application No. 61/349,522 filed on May 28, 2010, the disclosures of which are incorporated herein by reference in their entirety.

CROSS-REFERENCES TO RELATED APPLICATIONS

Not applicable.

BACKGROUND OF THE INVENTION

1. Field of the Invention

The present invention provides a light reflective structure for a light panel, as well as the light panel itself. In particular, the present invention provides a light panel which comprises a light reflective structure for uniformizing the light distribution.

2. Descriptions of the Related Art

Conventional light panels typically employ incandescent or fluorescent light sources. Both incandescent and fluorescent light sources have significant disadvantages since they consume a lot of power, produce a great deal of heat, are relatively inefficient and fragile, and have a short lifetime which results in frequent replacements. Moreover, fluorescent light sources contain mercury which is not environmental friendly and require complicated circuitry and substantial space for the location of the fluorescent lamps and circuitry thus, increasing the profile of the light panel.

Light Emitting Diodes (LEDs) have been previously employed in the field of illumination systems, for example, luminous signs for display, advertising purposes and directional signage. The conventional direct-lit backlight module used for a luminous signs comprises a plurality of LED light sources which are directly disposed under a panel. The typical LED light sources usually produce Lambertian lights, where the light output intensity of the Lambertian lights is strongest at 90 degrees. Then, the Lambertian lights emitted from the LED light sources pass through the diffuser layer of the light panel. So, for a light panel having the diffuser layer disposed too close to the LED light sources, the light output will be non-uniform and hot spots (i.e. the strongest light output intensity area) will be observed. The hot spots are usually located above the LED light sources, and severely affect the display quality of the light panel.

To eliminate the hot spot problem of light panels, it is important to provide an optical structure to mix lights well. Thereby, the lights provided by the LED light sources can be spread out evenly after being uniformized by this optical structure. Therefore, a light panel with a uniform light output can be obtained.

SUMMARY OF THE INVENTION

To solve the aforesaid problems, an objective of this invention is to provide a light panel which adapts LED light sources. The lights provided by this light panel would be uniformized so that there would not be any visible hot spots.

To achieve the abovementioned objective, the present invention discloses a light panel, which comprises a PCB substrate, a top conductor layer, a bottom conductor layer, a plurality of through holes, a control circuit, a plurality of light sources, a light reflective structure, and a diffuser layer. The light reflective structure comprises a plurality of concaves. Each of the concaves has a reflective surface to redirect all of the lights generated from the light sources upwards. The diffuser layer has a plurality of protrusions, and each protrusion has a different thickness profile which reduces the light intensity when the light, provided by the light sources, passes through the thicker region. In addition, the diffuser layer also has a sloping inner surface which reflects and scatters the lights sideways, and the lights generated from the light sources can be much more uniformized.

The present invention further provides a light panel, which comprises a PCB substrate, a top conductor layer, a bottom conductor layer, a plurality of through holes, a control circuit, a plurality of light sources, a light reflective structure, a diffuser layer, and a plurality of patterned diffuser coatings. The patterned diffuser coatings are coated on the top surface or bottom surface of the diffuser layer. The patterned diffuser coatings are distributed so that the regions that are closer to the light sources have more coverage while the regions that are further from the light sources have less coverage. The stronger lights at the central region are scattered more due to the larger coverage of the patterned diffuser coatings, while the weaker lights provided at the peripheral region will be scattered less due to less coverage of the patterned diffuser coatings. Therefore, the patterned diffuser coatings provide an improvement in uniformizing the overall light output. In this light panel, the diffuser layer may have either a sloping inner surface or a flat inner surface.

The present invention further provides a light panel, which may be based on one of the above recited light panels and further comprises a plurality of lenses. Each of the lenses is added on the top of each of the light sources and has a recess at a top surface thereof. With such a lens, the illumination angle would be increased and the lights would be uniformized thereby.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

In the following description, the light panel of the present invention will be explained with reference to embodiments thereof. It should be appreciated that these embodiments are not intended to limit the present invention to any specific environment, applications or particular implementations described in these embodiments. Therefore, the descriptions of these embodiments are only for purposes of illustration rather than limitation.

Figure 1:
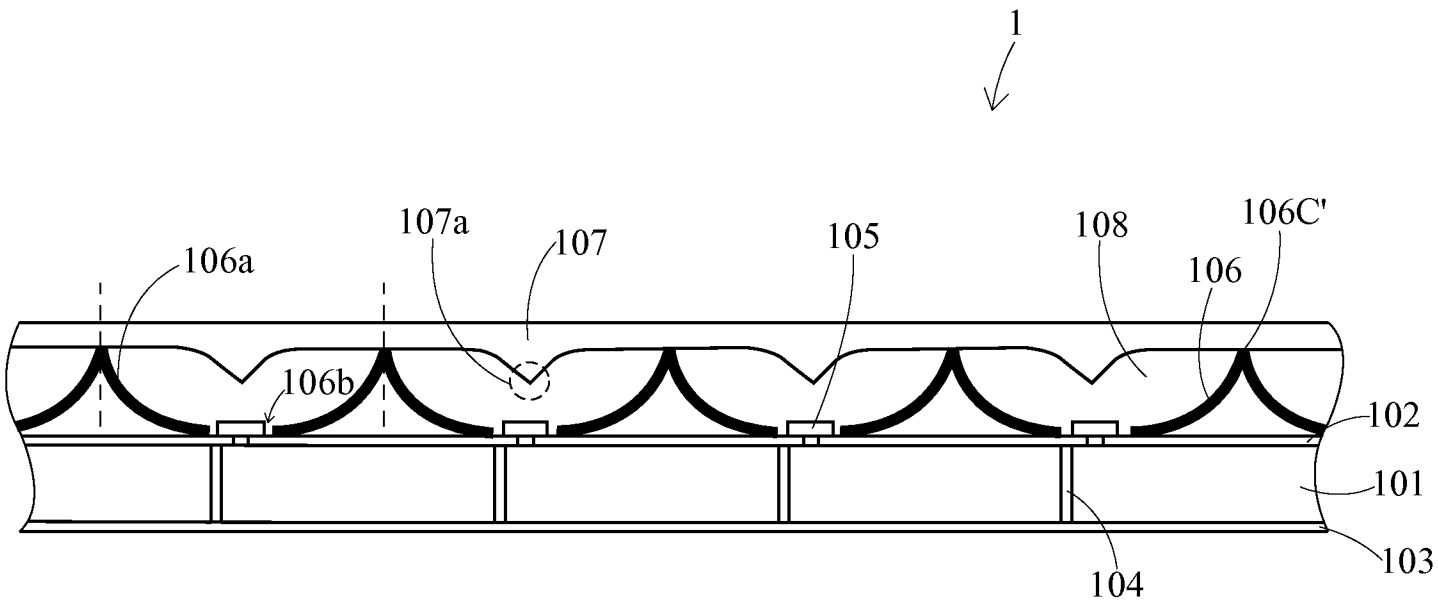
FIG. 1 is a cross sectional view of a light panel in accordance with the first embodiment of the subject invention.

First, FIG. 1 illustrates a cross sectional view illustrating the light panel 1 in accordance with the first embodiment of the present invention. The light panel 1 comprises a circuit assembly, which has a PCB substrate 101, a top conductor layer 102, a bottom conductor layer 103, a plurality of through holes 104, and a control circuit (not shown), and further comprises a plurality of light sources 105, a light reflective structure 106, and a diffuser layer 107.

In such a circuit assembly of the present embodiment, the top conductor layer 102 is formed on the top surface of the PCB substrate 101 and has a plurality of conductor lines (not shown) for circuit layout. More specifically, the top conductor layer 102 is a patterned electrode layer. The bottom conductor layer 103 is formed on the bottom surface of the PCB substrate 101 (i.e. below the PCB substrate 101) and has a plurality of conductor lines (not shown) for circuit layout. The through holes 104 are formed in the PCB substrate 101 to electrically connect the top conductor layer 102 and the bottom conductor layer 103 to form a plurality of circuit loops. The control circuit (not shown) electrically connects to the top conductor layer 102 through the through holes 104 and the bottom conductor layer 103 for providing control signals to control the illumination of light panel 1. In this embodiment, the PCB substrate 101 is a plastic substrate, and in other aspects, the PCB substrate 101 could be a metal core PCB or a ceramic substrate or a metal substrate with an electrical insulation coating.

It should be noted that the circuit assembly may additionally have other elements or omit some elements in other aspect. For example, it is known to the people skilled in the art that the circuit assembly may omit bottom conductor layer and through holes. Therefore, the top conductor layer, disposed on the PCB substrate, independently forms a circuit loop in other modifications of the present embodiment. Furthermore, the circuit assembly may comprise multiple layers of the PCB substrate and conductor layers to form a multilayer PCB in other modifications of the present embodiment.

As shown in FIG. 1, the light sources 105 are disposed on the PCB substrate 101 and are electrically connected to the top conductor layer 102. Thereby, the light sources 105 can be selectively activated by the control signals, provided by the control circuit and transmitted through the top conductor layer 102, the through holes 104 and the bottom conductor layer 103. The light sources 105 of the first embodiment are SMD type LED, and people skilled in this may use LED chips, which are electrically wire bonded with the top conductor layer. The light sources 105 of the first embodiment may be white LED, red LED, green LED, blue LED, or UV LED. As noted above, it is also known to the people skilled in the field that the circuit assembly can also only comprise the top conductor layer, and consequently, all of the light sources are electrically connected and controlled through the top conductor layer.

Figure 2A:
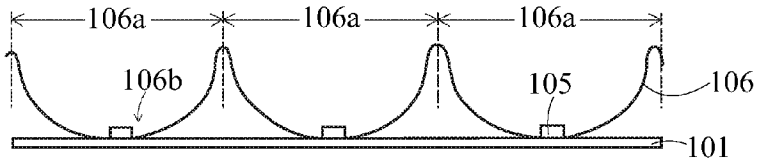
FIG. 2A is a cross sectional view of a part of the light panel in accordance with the first embodiment.
Figure 2B:
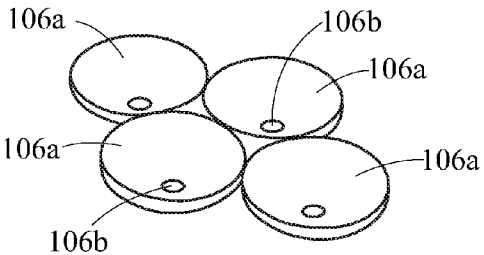
FIG. 2B is a top perspective view of the light reflective structure of FIG. 2A.
Figure 2C:
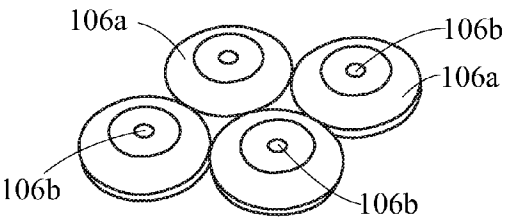
FIG. 2C is a bottom perspective view of the light reflective structure of FIG. 2A.

Furthermore, FIGS. 2A, 2B and 2C illustrate the light reflective structure 106 in the cross sectional view, the top perspective view, and the bottom perspective view, respectively. In this embodiment, the light reflective structure 106 is a continuous bowl-shaped reflective layer. The continuous bowl-shaped reflective layer comprises a plurality of bowl-shaped reflective concaves 106*a*. Each bowl-shaped reflective concave 106*a* is formed with an opening 106*b* at the bottom surface. The number of the bowl-shaped reflective concaves 106*a* is the same as that of the light sources 105. Therefore, each of the light sources 105 is disposed at the opening 106*b* of the corresponding bowl-shaped reflective concave 106*a*.

Each of the bowl-shaped reflective concaves 106*a* has a reflective surface to redirect all of the lights generated from the light sources 105 upward. The light reflective structure 106 can be made of plastic film or plastic sheet with a coated reflective surface on the top surface, i.e. the inner surface of each bowl. Specifically, the material of the light reflective structure 106 could be one of the following materials including PET, PEN, PS, PMMA, PVC, PC, PP, PE, PU, ABS, or a derivative thereof. The coated reflective surfaces of the light reflective structure 106 may be a metal thin film coating or a polymer resin layer containing titanium dioxide particles (ex. white poster paint), calcium carbonate particles, silicon oxide particles, metallic particles, air microvoids, or a mixture of plurality types of particles. In other aspects, the light reflective structure 106 can also be directly made of a highly reflective material, for example, a sheet metal or a white color plastic film such as PET, PEN, PMMA, PS, PP, PE, PVC, PU, ABS, MCPET (Micro Cellular PET), or a derivative thereof.

Figure 3A:
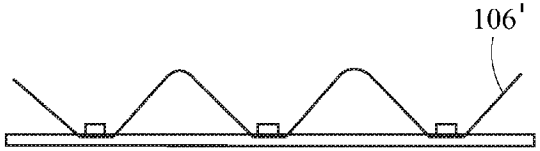
FIG. 3A is a cross sectional view of a part of the light panel in accordance with a modification of the first embodiment.
Figure 3B:
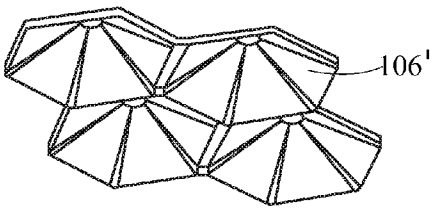
FIG. 3B is a top perspective view of the light reflective structure of FIG. 3A.
Figure 3C:
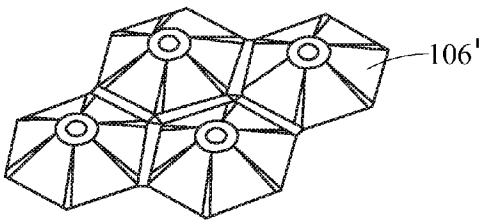
FIG. 3C is a bottom perspective view of the light reflective structure of FIG. 3A.

The shapes of the bowl-shaped reflective concaves 106*a* of the light reflective structure 106 of this embodiment are the same. In other aspects, the shapes of bowl-shaped reflective concaves 106*a* of the light reflective structure 106 can be different, and the shapes of bowl-shaped reflective concaves 106*a* can be selected from a bowl shape, a polygonal shape (such as a triangular shape, a hexagonal shape), and other shapes. For example, the cross sectional view, the top perspective view, and the bottom view of the hexagonal shape reflective concaves 106' are shown in FIGS. 3A, 3B, and 3C, respectively. The shape of the light reflective structure 106 can be formed by one of the following manufacturing processes including a molding process, an embossing process, a vacuum molding process, a hot pressing process, an injection molding process, a casting process, a stamping process, etc.

The diffuser layer 107 is semi-transparent, and one objective of the present invention is to adjust the light output intensity by means of the specific thickness profile of the diffuser layer 107. More specifically, the diffuser layer 107 has a plurality of protrusions 107*a*, each of which is a curved cone, is centrally aligned with the plurality of light sources and is thickest at the center region. More specifically, the diffuser layer 107 has a sloping inner surface, which reflects and scatters the lights sideways. Thereby, the light output intensity would be changed with the different thicknesses of different regions of the diffuser layer 107. For instance, the protrusions 107*a* reduce the light intensity when the light, provided by the light sources 105, passes through the thicker region. Thus, the lights generated from the light sources 105 can be much more uniformized, and thus, would not result in any visible hot spots.

Figure 4:
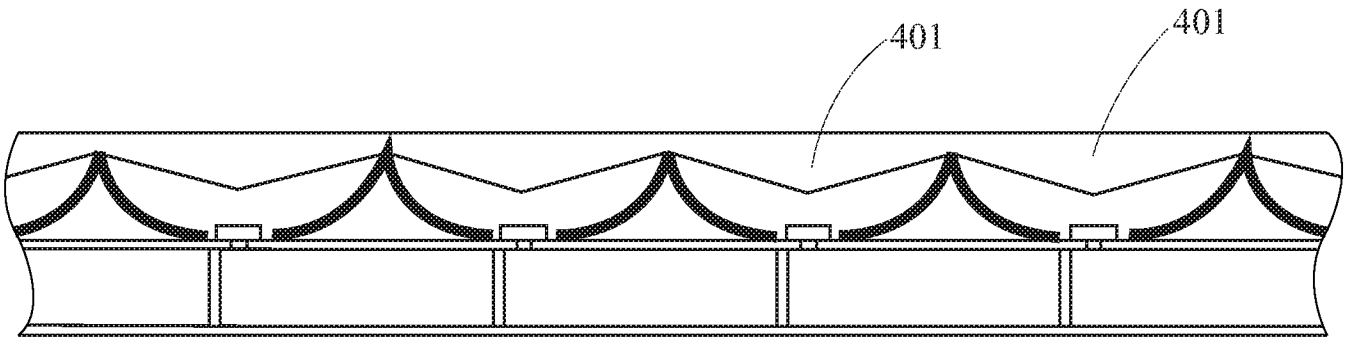
FIG. 4 is a cross sectional view of a light panel in accordance with another aspect of the first embodiment.

As shown in FIG. 1, some parabolic curved protrusion portions 107*a* of the diffuser layer 107 close to the light sources 105 are thicker than other portions of the diffuser layer 107 further away from the light sources 105. In other words, the sharp protrusion portions 107*a* are all in a bat wing shape. As a result of the thicker portions of the diffuser layer 107, the light output intensity would be reduced when the lights pass through. The diffuser layer 107 adopts a semi-transparent material, such as, PMMA, PC, PS, PU, PET, ABS, PVC, or a derivative thereof. In other aspects, the diffuser layer 107 can have different shapes and thickness profiles. The sloping inner surfaces of the diffuser layer 107 may have different sloping contours in other aspects. For example, the protrusion portion 107*a* of the diffuser layer 107 may be formed with sharp protrusions 401 as illustrated in FIG. 4.

As shown in FIG. 1, the ridges 106C' of the light reflective structure 106 act as spacers to support the diffuser layer 107 at the interconnecting portions among the bowl-shaped reflective concaves 106*a*. Because the ridge 106C' of the light reflective structure 106 and the diffuser layer 107 come into contact in a small area, light would be able to pass through the diffuser layer 107 from all directions. Therefore, there are no dark areas formed when the light panel 1 lightens.

Figure 5:
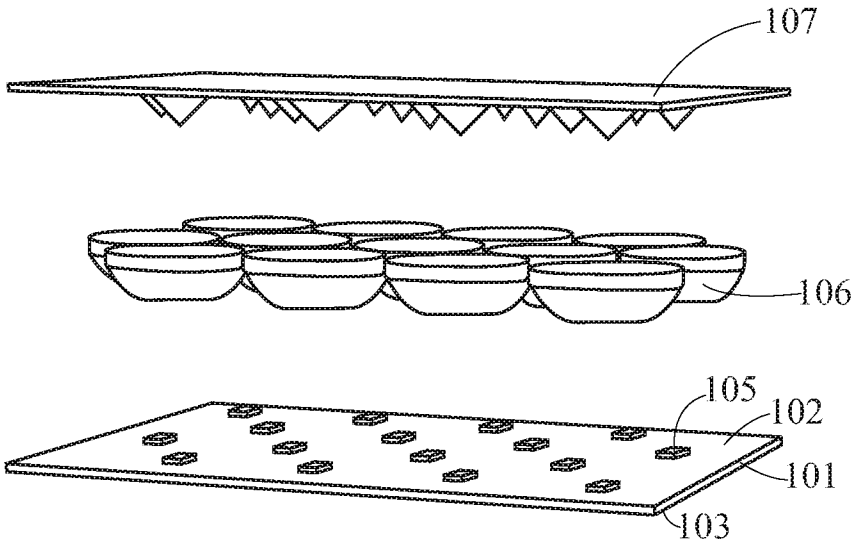
FIG. 5 is an exploded perspective view of the light panel of FIG. 1.

The air voids 108 are defined among the diffuser layer 107, the light reflective structure 106, and the light sources 105. Each air void 108 would correspond to a protrusion portion 107*a* of the diffuser layer 107, a light source 105, and a bowl-shaped reflective concave 106*a*. FIG. 5 is an exploded perspective view of the light panel 1 and assists the corresponding relationships of the diffuser layer 107, the light sources 105, and the bowl-shaped reflective concaves 106*a*.

Figure 6:
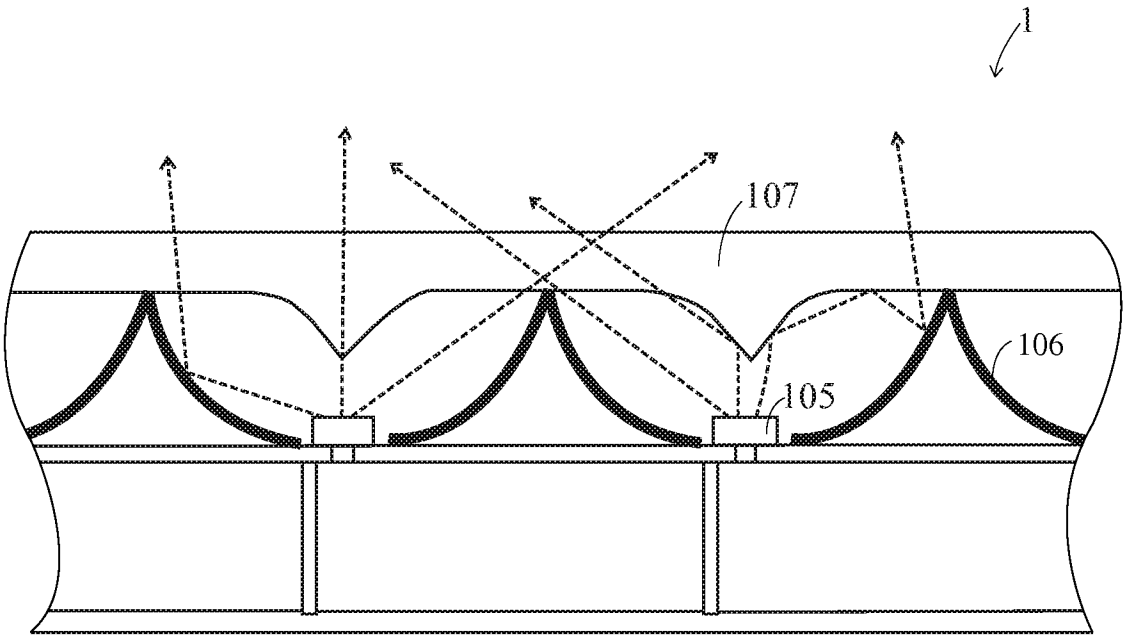
FIG. 6 is a schematic illustrating the light paths of the light panel of FIG. 1.

With the aforesaid arrangement of the light panel 1, all of the lights generated from the light sources 105 may pass through the diffuser layer 107 or may bounce off one of the diffuser layer 107 (due to total reflection or interface reflection) and the light reflective structure 106, and then the lights are eventually emitted out of the diffuser layer 107 as shown in FIG. 6.

Figure 7:
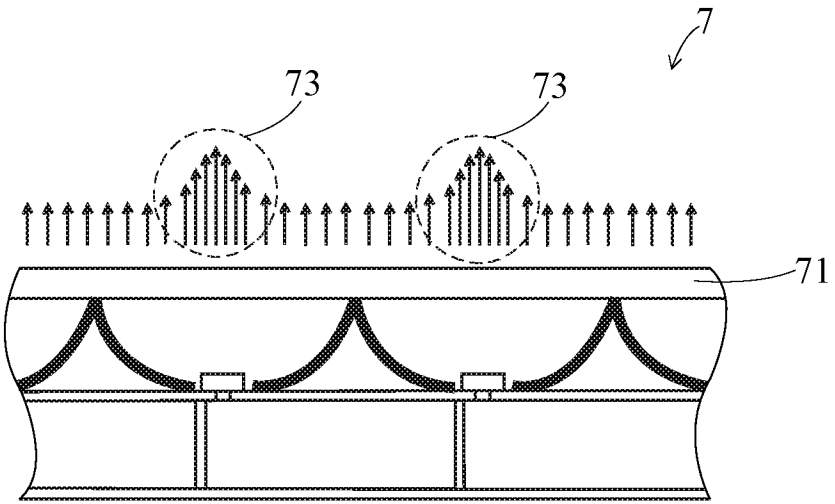
FIG. 7 is a schematic illustrating the light intensity of a light panel, which is not configured with a specific designed diffuser layer.
Figure 8:
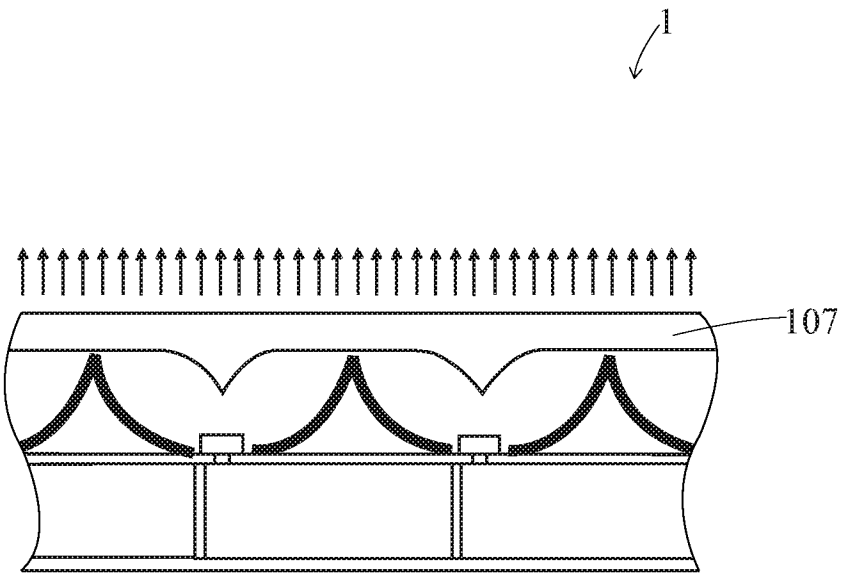
FIG. 8 is a schematic illustrating the light intensity of the light panel of FIG. 1.

FIG. 7 illustrates the light intensity of a conventional light panel 7, which is not configured with a specific designed diffuser layer. More specifically, the inner surface of the diffuser layer 71 in FIG. 7 is a flat surface, and hot spots 73 are formed above the light sources. FIG. 8 illustrates the light intensity of the aforementioned light panel 1 with a specific designed diffuser layer 107. As shown in these two figures, the diffuser layer of the present invention shows the more even light intensity and would provide better optical effects.

Figure 9A:
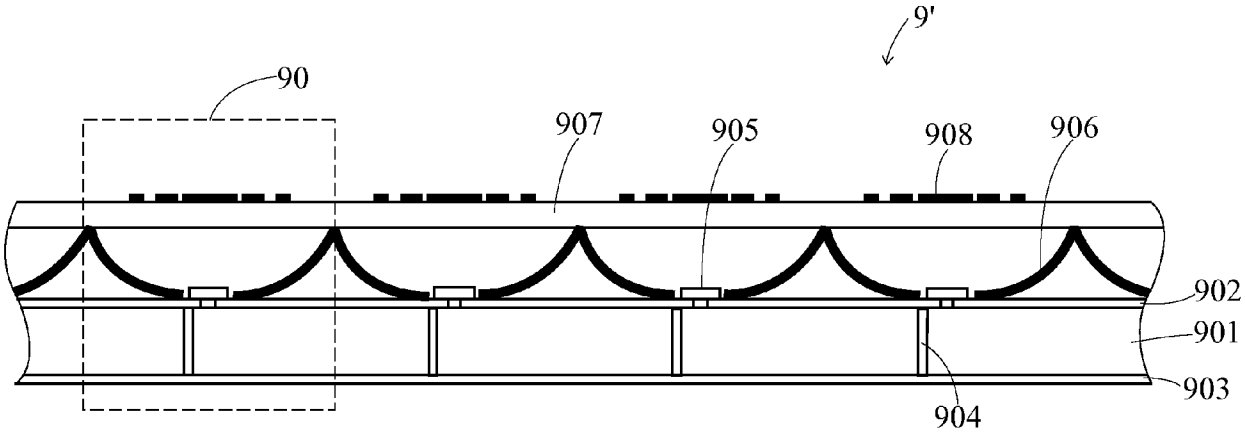
FIG. 9A is a cross sectional view of a light panel in accordance with the second embodiment.

The second embodiment of the present invention is shown in FIG. 9A. The light panel 9 has a structure generally similar to that of the light panel 1 of the first embodiment, so only differences of this embodiment from the aforesaid embodiment will be described hereinafter. In detail, in addition to comprising a PCB substrate 901, a top conductor layer 902, a bottom conductor layer 903, a plurality of through holes 904, a control circuit (not shown), a plurality of light sources 905, a light reflective structure 906, and a diffuser layer 907, the light panel 9 further comprises a plurality of patterned diffuser coatings 908. Moreover, despite further comprising the patterned diffuser coatings 908, the inner surface of the diffuser layer 907 of this embodiment is not a sloping surface but a plane surface. The detailed descriptions of the elements, such as the PCB substrate 901 and the light sources 902, of the light panel 9 of the second embodiment are similar to those of the light panel 1 of the first embodiment and thus, would be omitted herein for concision.

The patterned diffuser coatings 908 are coated on the top surface of the diffuser layer 907. FIG. 9A shows the cross sectional view illustrating the light panel 9 and the patterned diffuser coatings 908, which are located with respect to the light sources 905. In detail, the light panel 9 comprises a plurality of lighting units 90, and each of the lighting units 90 has a part of the PCB substrate 901, a part of the top conductor layer 902, a part of the bottom conductor layer 903, one of the through holes 904, a part of the control circuit (not shown), one of the light sources 905, a part of the light reflective structure 906, a part of the diffuser layer 907, and a part of the patterned diffuser coatings 908.

In each lighting unit 90, the light source 905 is disposed at the center. The patterned diffuser coatings 908 have a different coverage from the central region of the lighting unit 90 towards the peripheral region of the lighting unit 90. The diffuser layer 907 has a plurality of high coverage areas and a plurality of low coverage areas. In each lighting unit 90, one of the high coverage areas is positioned close to the light sources 905, and two of the low coverage areas are positioned away from the light sources 905. In other words, the patterned diffuser coatings 908 are distributed so that the region closer to the light sources 905 has more coverage while the region further away from the light sources 905 has less coverage. The patterned diffuser coatings 908 scatter the lights traveling along the normal of the diffuser layer 907 to obtain a better light uniformity. In this way, the stronger lights provided at the central region will be scattered more due to a larger coverage of the patterned diffuser coatings 908, and the weaker lights provided at the peripheral region will be scattered less due to less coverage of the patterned diffuser coatings 908. Therefore, the patterned diffuser coatings 908 can provide an additional improvement by making the overall light output more uniform. It should be noted that the pattern of the patterned diffuser coatings 908 of FIG. 9A is only for illustration purposes and is not limited thereto.

The material of the patterned diffuser coatings 908 is polymer resin containing lighting scattering particles such as titanium dioxide particles, calcium carbonate particles, silica oxide particles, metallic particles, air microvoids, or a derivative thereof. The patterned diffuser coatings 908 can be coated by screen printing, inkjet printing, gravure printing, flexo printing, stamping, metal deposition, etc. Moreover, it should be easy for the people skilled in this field to proceed to coat the patterned diffuser coatings on the bottom surface of the diffuser layer in other modifications of the second embodiment.

Figure 9B:
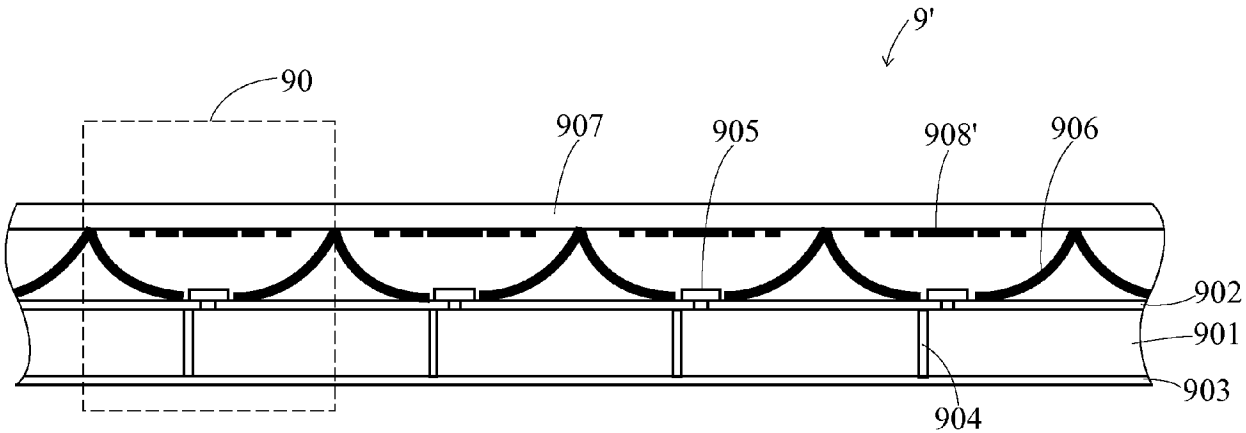
FIG. 9B is a cross sectional view of a light panel in accordance with another aspect of the second embodiment.

To obtain more uniform lights, people skilled in this art may proceed with other modifications according to the recited technical features of the present invention. As shown in FIG. 9B, which illustrates a cross sectional view illustrating the light panel 9' in accordance with a modification of the second embodiment, the light panel 9' is similar to the light panel 9 except for the position of a plurality of patterned diffuser coatings 908'. In other words, the patterned diffuser coatings may also be coated on the bottom surface of the diffuser layer. With such mechanism, the light panel 9' would provide much even light by contrast with the light panel 9.

Figure 10:
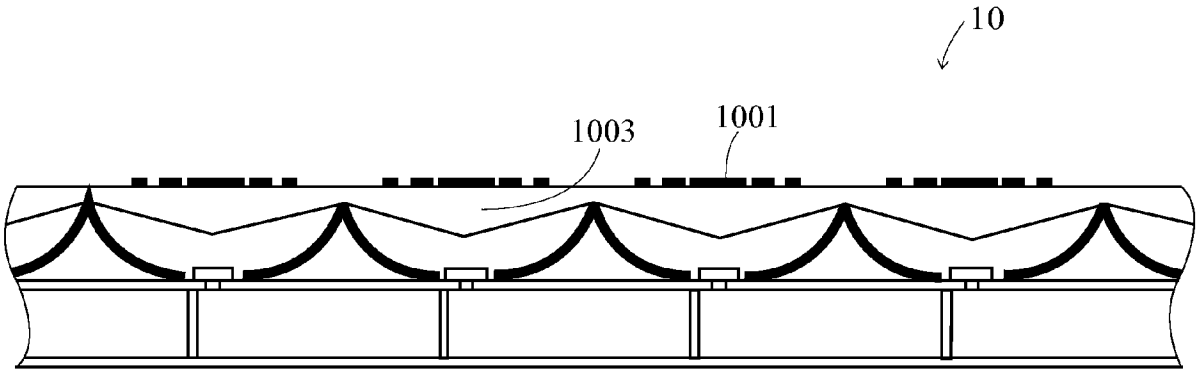
FIG. 10 is a cross sectional view of a light panel in accordance with another aspect of the second embodiment.

According to the aforementioned features, people skilled in this field may proceed with a modification of the light panel of the second embodiment. FIG. 10 illustrates another aspect of the second embodiment of the present invention. The light panel 10 comprises both a plurality of patterned diffuser coatings 1001 and a diffuser layer 1003, which has a specific thickness profile (like the sharp protrusions 401, illustrated in FIG. 4 and formed by a sloping inner surface), and this light panel 10 can be used to improve the light output uniformity more effectively.

Figure 11:
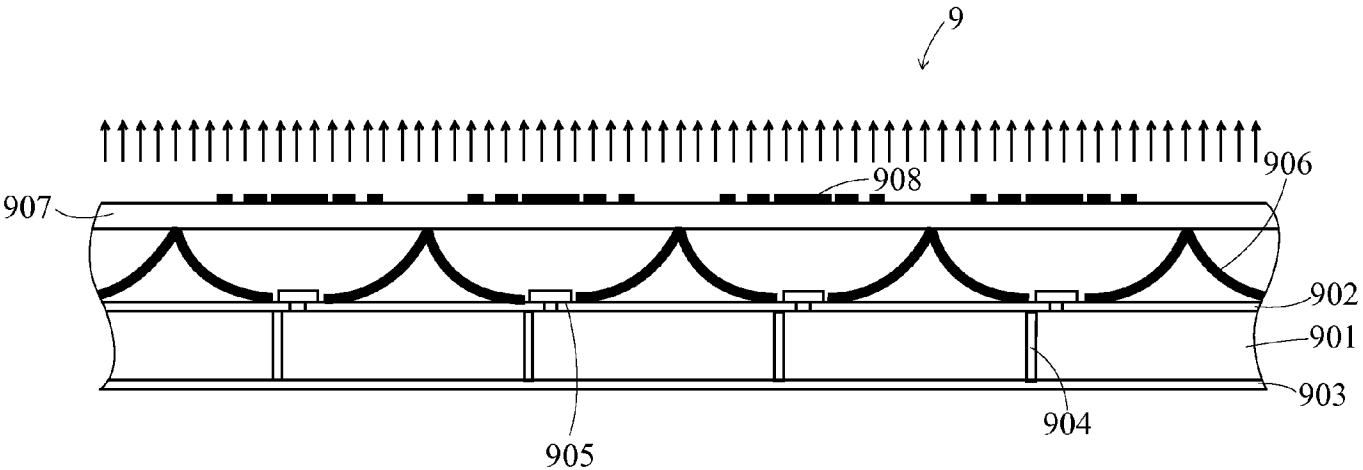
FIG. 11 is a schematic illustrating the light intensity of the light panel of FIG. 9A.

FIG. 7 illustrates the light intensity of a conventional light panel 7, which is not configured with a specific designed diffuser layer. More specifically, the inner surface of the diffuser layer 71 in FIG. 7 is a flat surface, and hot spots 73 are formed above the light sources. FIG. 11 illustrates the light intensity of the aforementioned light panel 9 with a specific designed diffuser layer 908. Comparing with the light intensity of the conventional light panel 7 of the abovementioned FIG. 7, the light intensity of the light panel 9 of subject would be more even and provide better optical effects thereby.

Figure 12A:
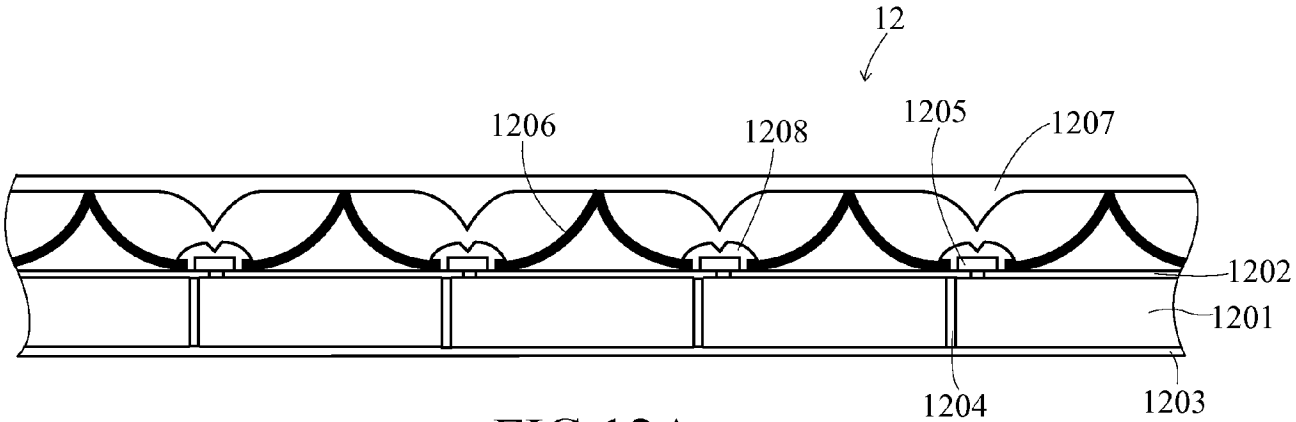
FIG. 12A is a cross sectional view of a light panel in accordance with the third embodiment.

FIG. 12A shows a third embodiment of the present invention. The light panel 12 of the third embodiment comprises a PCB substrate 1201, a top conductor layer 1202, a bottom conductor layer 1203, a plurality of through holes 1204, a control circuit (not shown), a plurality of light sources 1205, a light reflective structure 1206, and a diffuser layer 1207, and a plurality of lenses 1208. The light panel 12 of the third embodiment is similar to the light panel 1 of the first embodiment except for adding the lenses 1208, and therefore, the detailed description of the similar elements are omitted herein for concision.

Each of the lenses 1208 is disposed on the top of each of the light sources 1205. More specifically, each of the lenses 1208 is formed with a cone-shaped recess at the top surface, where the cone-shaped recess is aligned with each of the light sources 1205. With such a lens 1208, the illumination angle would be increased, for example, from 120° to 160°. The uniform lights output from the diffuser layer 1207 and can be obtained without coating the patterned diffuser coatings on the diffuser layer 1207 or changing the thickness of the diffuser layer 1207. More specifically, the top surface of the cone-shaped recess of each lens 1208 is curved in the present embodiment, and people skilled in this technical field may proceed with a modification of the cone-shaped recess.

It should be noted that the diffuser layer 1207 of the light panel 12 can be modified to different shapes and thickness profiles.

Figure 12B:
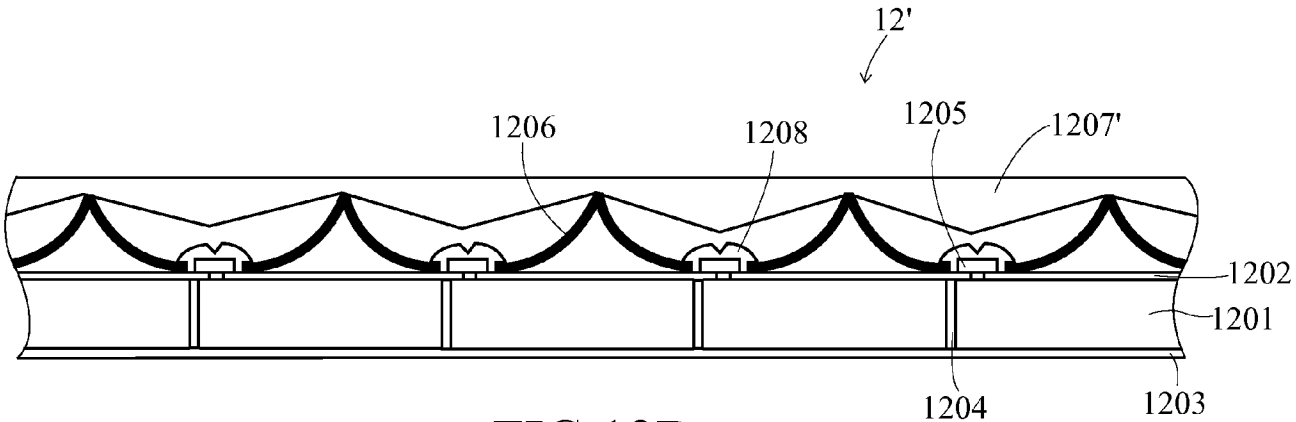
FIG. 12B is a cross sectional view of a light panel in accordance with another aspect of the third embodiment.

As illustrated in FIG. 12B, the sloping inner surfaces of the diffuser layer 1207' of the light panel 12' may be formed with sharp protrusions. For example, FIG. 12B illustrates a cross sectional view illustrating the light panel 12, which is a modification of the third embodiment. In stead of having a diffuser layer 1201 with the curved cone protrusions, the light panel 12' has a diffuser layer 1207' with the sharp protrusions as stated above (i.e. sharp protrusions 401 as illustrated in FIG. 4) and lenses 1208 with cone-shaped recesses at the top surface thereof as stated in the third embodiment. With the diffuser layer 1207' and the lenses 1208, the light panel 12' would provide much more uniformized light emission.

Figure 13A:
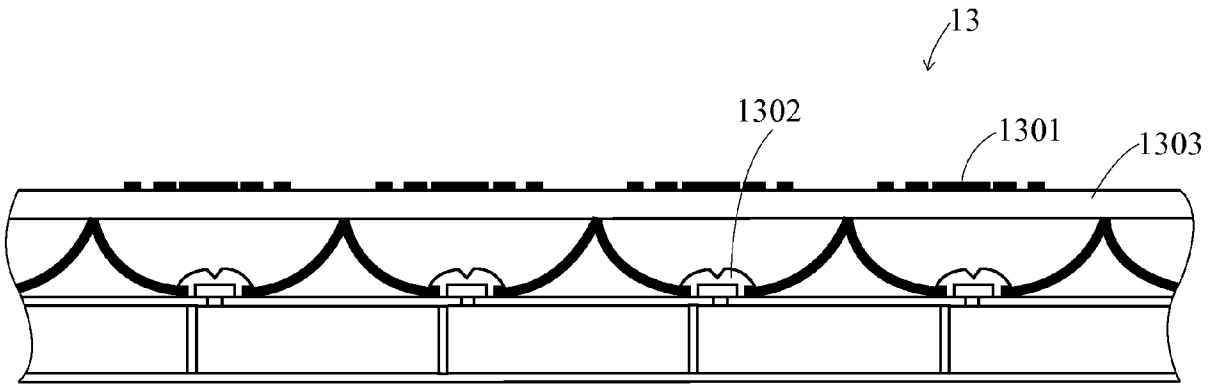
FIG. 13A is a cross sectional view of a light panel in accordance with another aspect of the third embodiment.

FIG. 13A shows another modification. As shown in this figure, the light panel 13 has a plurality of patterned diffuser coatings 1301, which is the same as the patterned diffuser coatings 908 stated in the second embodiment, and lenses 1302, which is the same as the lenses 1208 stated in the third embodiment. With the patterned diffuser coatings 1301 and the lens 1302, the lights emitted from the light panel 13 would be more uniform. It should be noted that the light panel 13 has a diffuser layer 1303 which has a flat inner surface.

Figure 13B:
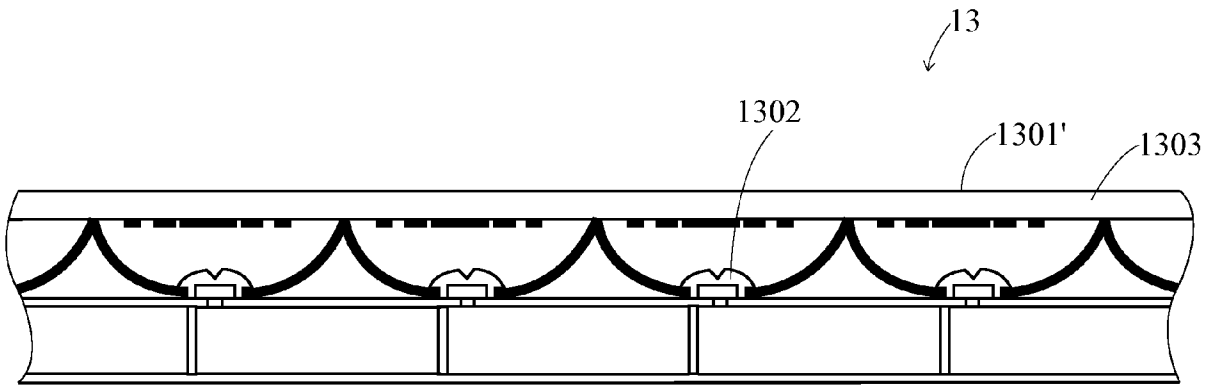
FIG. 13B is a cross sectional view of a light panel in accordance with another aspect of the third embodiment.

To obtain more uniform lights, people skilled in this art may proceed with other modifications according to the recited technical features of the present invention. As shown in FIG. 13B, which illustrates a cross sectional view illustrating the light panel 13' in accordance with a modification of the light panel 13, the light panel 13' is similar to the light panel 13 except for the position of a plurality of patterned diffuser coatings 1301'. In other words, the patterned diffuser coatings may also be coated on the bottom surface of the diffuser layer. With such mechanism, the light panel 13' would provide much even light by contrast with the light panel 13.

Figure 14:
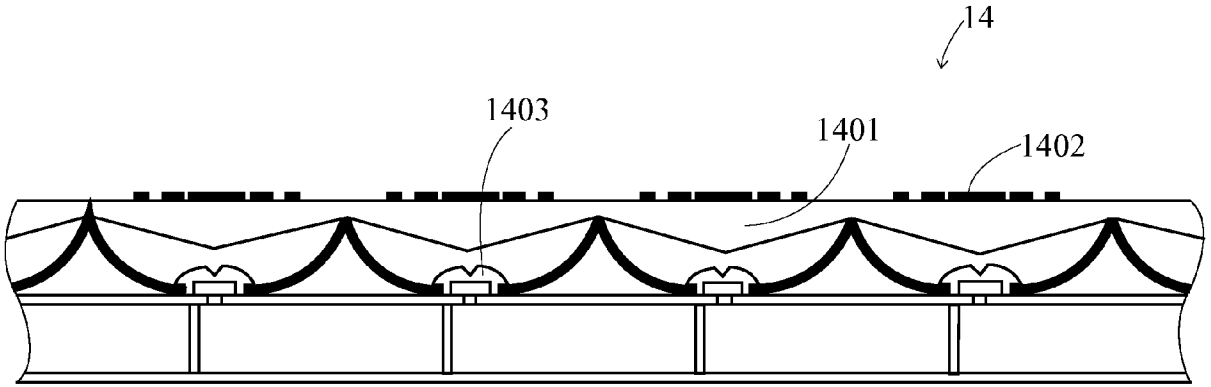
FIG. 14 is a cross sectional view of a light panel in accordance with another aspect of the third embodiment.

Moreover, a light panel 14 illustrated in FIG. 14 combines a diffuser layer 1401 with the specific thickness profile as the diffuser layer 107 stated in the first embodiment, a patterned diffuser coatings 1402 as the patterned diffuser coatings 908 stated in the second embodiment, and lenses 1403 with cone-shaped recesses as the lenses 1208 stated in the third embodiment.

The fourth embodiment of the present invention is a modification of the first embodiment. In reference to FIG. 15, the light panel 15 of the fourth embodiment comprises a PCB substrate 1501, a top conductor layer 1502, a bottom conductor layer 1503, a plurality of through holes 1504, a control circuit (not shown), a plurality of light sources 1505, a light reflective structure 1506, and a diffuser layer 1507. Moreover, the light panel 15 further comprises a plurality of posts 1508. The light panel 15 of this embodiment is similar to the light panel 1 of the first embodiment except for the posts 1508, and therefore, the detailed description of the similar elements are omitted herein for concision.

Figure 15:
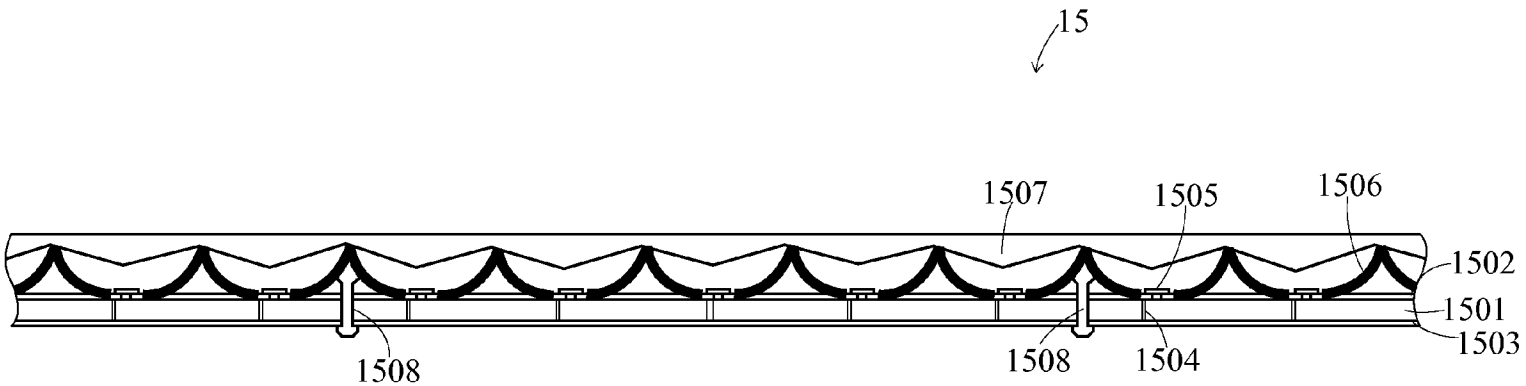
FIG. 15 is a cross sectional view of a light panel in accordance with the fourth embodiment.
Figure 16:
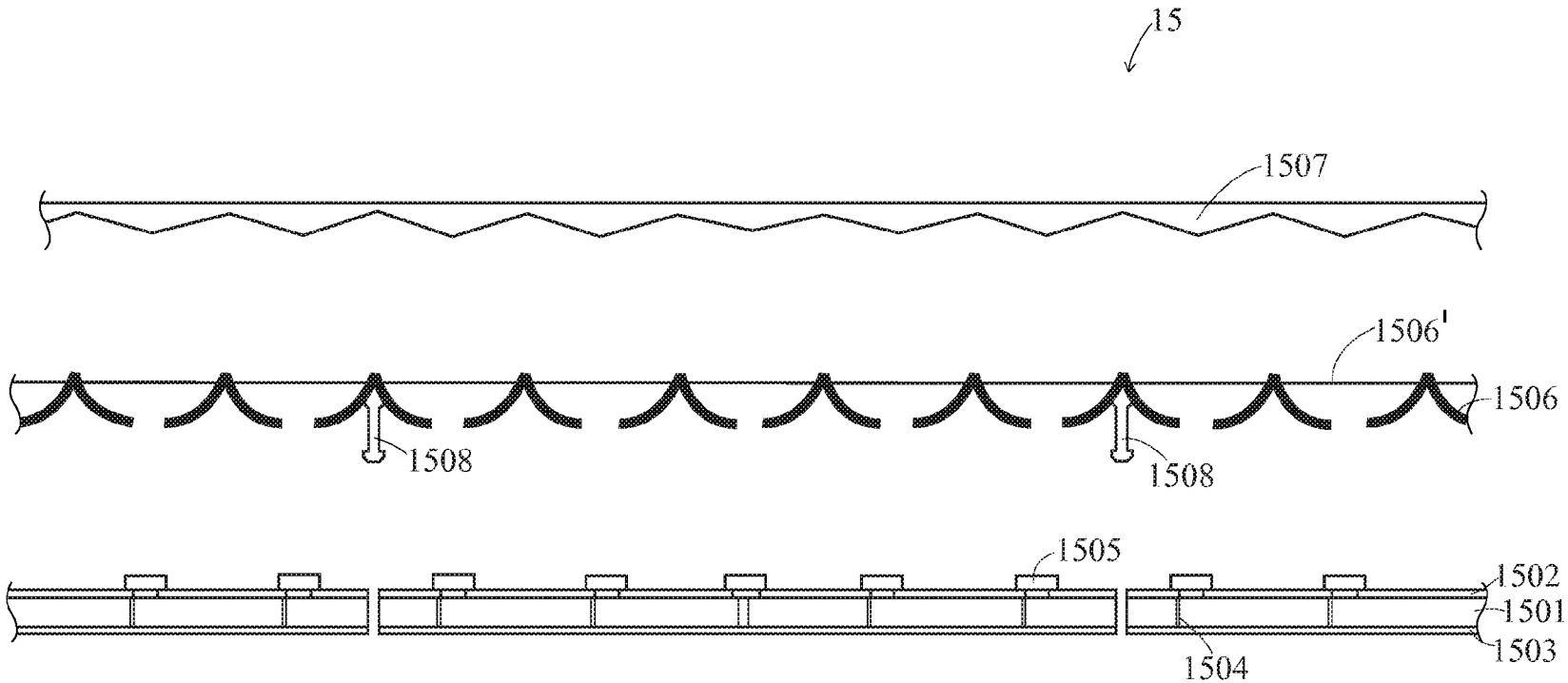
FIG. 16 is an exploded view of the light panel of FIG. 15.

The following descriptions are in reference to FIGS. 15 and 16. The posts 1508 are formed with the light reflective structure 1506 that is easily fixed directly onto the PCB substrate 1501. According to FIG. 16, which is an exploded view of the light panel 15, which is not assembled, the light reflective structure 1506 and the posts 1508 are fixed onto a plate 1506' to simplify the assembly process.

Furthermore, because all of the stray lights provided by the light sources 1505 will be reflected ideally by the light reflective structure 1506, there is no harm in changing the shape of the back side of the light reflective structure 1506. Therefore, any change in the post design of the back side of the light reflective structure 1506 would not influence the reflection of the lights; that is the light panel 15 still provides uniform lights. In addition to the above-mentioned assembly, people skilled in this technical field may design different mechanical shapes for assembly purposes.

Figure 17:
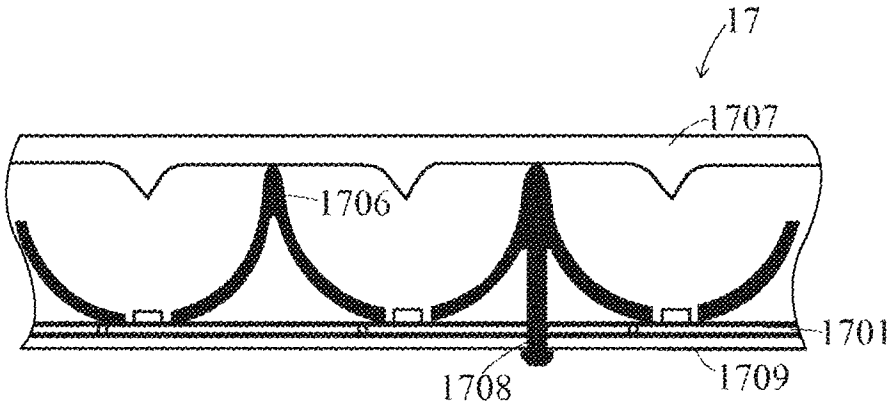
FIG. 17 is an exploded view of a light panel, which is not assembled with a case yet.

Before becoming the final product, the light panel needs to be disposed in a case for packing. The case can be a plastic cover or a metal frame. Therefore, the post design as mentioned above can also be applied. FIG. 17 illustrates the cross sectional view of the light panel 17 and the case 1709 before and after assembly, respectively. Similarly, the light panel 17 comprises a PCB substrate 1701, a top conductor layer 1702, a bottom conductor layer 1703, a plurality of through holes 1704, a control circuit (not shown), a plurality of light sources 1705, a light reflective structure 1706, a diffuser layer 1707, and a plurality of posts 1708. Next, the descriptions are in reference to FIG. 17, in which the light panel 17 is packed into the case 1709 as the final product. Both the PCB substrate 1701 of the light panel 17 and the case 1709, which may be made of metal, can be fixed at the same time through the protruded posts 1708 connected with the light reflective structure 1709. This post design simplifies the final product assembly of the light panel, which means that the light panel and the case would be easily assembled as the final product.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered by the technical concept of the present invention.

What is claimed is:

1. A light panel, comprising:

a circuit assembly;

a plurality of light sources, being disposed on and electrically connected to the circuit assembly;

a light reflective structure, having a plurality of concaves and a plurality of posts, wherein the concaves are continuously connected to form a plurality of ridges and the posts are formed on back sides of the ridges, each of the plurality of concaves has an opening formed on a bottom surface thereof, and each of the plurality of light sources is disposed corresponding to each of the openings of the plurality of the concaves;

a diffuser layer, being supported by the plurality of ridges of the light reflective structure and comprising a plurality of protrusions, which are centrally aligned with the plurality of light sources and within the concaves; and a plurality of lenses disposed on the plurality of light sources, wherein each of the lenses has a recess at a top surface thereof.

2. The light panel of claim 1, wherein the plurality of light sources are LEDs.

3. The light panel of claim 1, wherein the plurality of concaves have a bowl shape, a polygonal shape, or a derivative thereof.

4. The light panel of claim 1, wherein the light reflective structure is made of a material of PET, PEN, PS, PMMA, PVC, PC, PP, PE, PU, ABS, MCPET (Micro Cellular PET), or a derivative thereof.

5. The light panel of claim 1, wherein the light reflective structure is coated with a metal layer, a white reflective layer, or a polymer resin, which contains titanium dioxide particles, calcium carbonate particles, silicon oxide particles, metallic particles, air microvoids, or a mixture of plurality types of particles.

6. The light panel of claim 1, wherein each of the plurality of protrusions is a cone shape.

7. The light panel of claim 1, wherein the diffuser layer is made of a material of a semi-transparent material, PC, PMMA, PS, PU, PET, ABS, PVC, or a derivative thereof.

8. The light panel of claim 1, wherein the diffuser layer comprises a plurality of patterned diffuser coatings, coated on one of a top surface and a bottom surface thereof, the diffuser layer having a plurality of high coverage areas and a plurality of low coverage areas, the high coverage areas being positioned close to the plurality of light sources, and the low coverage areas being positioned away from the plurality of light sources.

9. The light panel of claim 8, wherein the plurality of patterned diffuser coatings are made of a material of polymer resin containing lighting scattering particles such as titanium dioxide particles, calcium carbonate particles, silica oxide particles, metallic particles, air microvoids, and a derivative thereof.

10. A light panel, comprising:

a circuit assembly;

a plurality of light sources, being disposed on and electrically connected to the circuit assembly;

a light reflective structure, having a plurality of concaves and a plurality of posts, wherein the concaves are continuously connected to form a plurality of ridges and the posts are formed on back sides of the ridges, each of the plurality of concaves has an opening formed on a bottom surface thereof, and each of the plurality of light sources is disposed corresponding to each of the openings of the plurality of the concaves;

a diffuser layer, being supported by the plurality of ridges of the light reflective structure and comprising a plurality of patterned diffuser coatings, coated on a surface thereof, the diffuser layer having a plurality of high coverage areas and a plurality of low coverage areas, the high coverage areas being positioned close to the plurality of light sources, and the low coverage areas being positioned away from the plurality of light sources, wherein the diffuser layer further comprises a plurality of protrusions, which are centrally aligned with the plurality of light sources and within the concaves; and a plurality of lenses disposed on the plurality of light sources, wherein each of the lenses has a recess at a top surface thereof.

11. The light panel of claim 10, wherein the plurality of light sources are LEDs.

12. The light panel of claim 10, wherein the plurality of concaves have a bowl shape, a polygonal shape, or a derivative thereof.

13. The light panel of claim 10, wherein the light reflective structure is made of a material of PET, PEN, PS, PMMA, PVC, PC, PP, PE, PU, ABS, MCPET (Micro Cellular PET), or a derivative thereof.

14. The light panel of claim 10, wherein the light reflective structure is coated with a metal layer, a white reflective layer, or a polymer resin, which contains titanium dioxide particles, calcium carbonate particles, silicon oxide particles, metallic particles, air microvoids, or a mixture of plurality types of particles.

15. The light panel of claim 10, wherein the diffuser layer has a plurality of protrusions, which are centrally aligned with the plurality of light sources.

16. The light panel of claim 15, wherein each of the plurality of protrusions is a cone shape.

17. The light panel of claim 10, wherein the diffuser layer is made of a material of a semi-transparent material, PC, PMMA, PS, PU, PET, ABS, PVC, or a derivative thereof.

18. The light panel of claim 10, wherein the plurality of patterned diffuser coatings are made of a material of polymer resin containing lighting scattering particles such as titanium dioxide particles, calcium carbonate particles, silica oxide particles, metallic particles, air microvoids, and a derivative thereof.

* * * * *